US008656837B2

(12) United States Patent
Pisella et al.

(10) Patent No.: US 8,656,837 B2
(45) Date of Patent: Feb. 25, 2014

(54) SAFETY AND ARMING DEVICE FOR PROJECTILES INERTIAL LOCK WITH MEMS TECHNOLOGY

(75) Inventors: Christian Pisella, Beaucroissant (FR); Christophe Kergueris, Grenoble (FR)

(73) Assignee: Nexter Munitions, Versailles (FR)

( * ) Notice: Subject to any disclaimer, the term of this patent is extended or adjusted under 35 U.S.C. 154(b) by 255 days.

(21) Appl. No.: 13/176,307

(22) Filed: Jul. 5, 2011

(65) Prior Publication Data

US 2012/0000389 A1 Jan. 5, 2012

(30) Foreign Application Priority Data

Jul. 2, 2010 (FR) ..... 10 02825

(51) Int. Cl.
*F42C 15/26* (2006.01)

(52) U.S. Cl.
USPC ..... 102/231

(58) Field of Classification Search
USPC ..... 102/221, 222, 226, 229, 231, 233, 235, 102/237, 244, 245, 247, 249, 251, 254, 256, 102/242
See application file for complete search history.

(56) References Cited

U.S. PATENT DOCUMENTS 3,603,259 A * 9/1971 Webb ..... 102/235
4,195,575 A * 4/1980 Deuker et al. ..... 102/232
6,064,013 A 5/2000 Robinson
6,167,809 B1 * 1/2001 Robinson et al. ..... 102/235
6,321,654 B1 11/2001 Robinson

FOREIGN PATENT DOCUMENTS

EP 1 780 496 A1 5/2007
EP 2 077 431 A2 7/2009
FR 2 932 561 A1 12/2009

OTHER PUBLICATIONS

Search Report issued in French Application No. FR 1 002 825 dated Mar. 18, 2011 (with translation).

* cited by examiner

*Primary Examiner* — Michael Carone
*Assistant Examiner* — Reginald Tillman, Jr.
(74) *Attorney, Agent, or Firm* — Oliff PLC

(57) ABSTRACT

The invention relates to a safety and arming device for projectiles and using micro-electromagnetic technology, such device incorporating a slider made mobile by the effect of the centrifugal acceleration with respect to the body of the device and immobilized in a safety position by at least one inertial lock, such lock incorporating at least one means to ensure its blocking in the unlocked position, wherein the inertial lock incorporates a counterweight having at least one straight groove whose longitudinal axis is parallel to the direction of movement of the lock, groove in which a fixed guiding pin integral with the safety and arming device is positioned, since the groove is of sufficient length to allow the displacement of the counterweight with respect to the pin, the slider in its safety position being made integral with the body of the safety and arming device by means of hooking means integral with the counterweight.

8 Claims, 3 Drawing Sheets

SAFETY AND ARMING DEVICE FOR PROJECTILES INERTIAL LOCK WITH MEMS TECHNOLOGY

BACKGROUND OF THE INVENTION

1. Field of the Invention

The technical scope of the invention is that of safety and arming devices for projectiles, using micro-electromechanical technology.

2. Description of the Related Art

It is known to produce mechanical Safety and Arming Devices (SAD) that are incorporated into projectile fuses of any caliber. Today, these devices are sought to be made using MEMS (Micro Electro Mechanical Systems) technology enabling them to be considerably miniaturized making them able to be integrated into medium caliber projectiles, for example.

The purpose of safety and arming devices (SAD) is to isolate the detonator and explosive load of a projectile and to enable these two components of the pyrotechnic train to communicate only (according to present-day standards such as STANAG 4157) when at least two distinct firing environment conditions appear. The isolation between the detonator and the explosive load is more often than not made in the form of a plate, also called a screen, slider or barrier, which obstructs the slot by which these two components of the pyrotechnic train are made to communicate.

The firing environment conditions retained to allow the slide to be retracted are often as illustrated in EP-2077431 firstly the acceleration along the firing axis, and secondly, the spin acceleration of the projectile around its axis due to its spin-stabilization (firing from a rifled barrel).

Patent EP-2077431 uses these two loads in order, firstly, to release an inertial lock with a counterweight thanks to the acceleration along the firing axis then, secondly, to make the slider move transversally into a position in which it releases the slot thanks to the spin acceleration.

As it is presented in EP-2077431, the device suffers two drawbacks.

Firstly, the slider is hooked only to the inertial lock. The transversal stresses received by the slider further to impacts on the device (for example during the logistic phases or when the projectile is being rammed into position in the weapon) are thus communicated by the slider to the lock which risks being deviated and blocked and not being able to be released during firing.

Secondly, the lock's counterweight is subjected after unlocking to the transversal stresses due to the projectile's spin. These transversal stresses push the counterweight towards the slider and can cause it to unlock or even to be positioned in front of the slot, thereby disturbing priming.

By FR-2932561 a safety and arming device is also known that comprises a mobile screen immobilized by an inertial lock. The screen is armed by means of a gas generator. Such a device is not implemented in a projectile subjected to spin acceleration and the problem the invention is trying to overcome does not arise in this device. Note that the implementation of a gas generator to move the screen is a complicated and costly solution made necessary because of the absence of sufficient centrifugal inertia.

SUMMARY OF THE INVENTION

The invention proposes to overcome the problems encountered in a device such as that described in EP-2077431 firstly by making the lock integral with the body of the device and secondly by guiding the lock's counterweight on its trajectory.

The invention thus relates to a safety and arming device for projectiles, using micro-electromagnetic technology, such device incorporating a slider made mobile by the effect of the centrifugal acceleration with respect to the body of the device and immobilized in a safety position by at least one inertial lock, such lock incorporating at least one means to ensure its blocking in the unlocked position, device wherein the inertial lock incorporates a counterweight having at least one straight groove whose longitudinal axis is parallel to the lock's direction of movement, groove in which a fixed guiding pin integral with the safety and arming device is positioned, since the groove is of sufficient length to allow the displacement of the counterweight with respect to the pin, the slider in its safety position being made integral with the body of the safety and arming device by means of hooking means integral with the counterweight.

Advantageously, the hooking means incorporate at least one spigot matching at least a first hook shape integral with the slider and at least a second spigot matching at least a second hook shape integral with the body of the safety and arming device, the first and second spigots being oriented in the same direction, the ends of the spigots being oriented in the opposite direction to the direction of movement that unlocks the counterweight.

According to another characteristic of the invention, the guiding pin may incorporate a rectangular section substantially occupying the full width of the groove.

Advantageously, the counterweight is suspended between at least two springs whose principal strain axis is parallel to the lock's direction of movement.

BRIEF DESCRIPTION OF THE DRAWING

The invention will become more apparent from the following additional description made in reference to the appended drawings, in which.

DETAILED DESCRIPTION OF PREFERRED EMBODIMENTS

Figure 1:
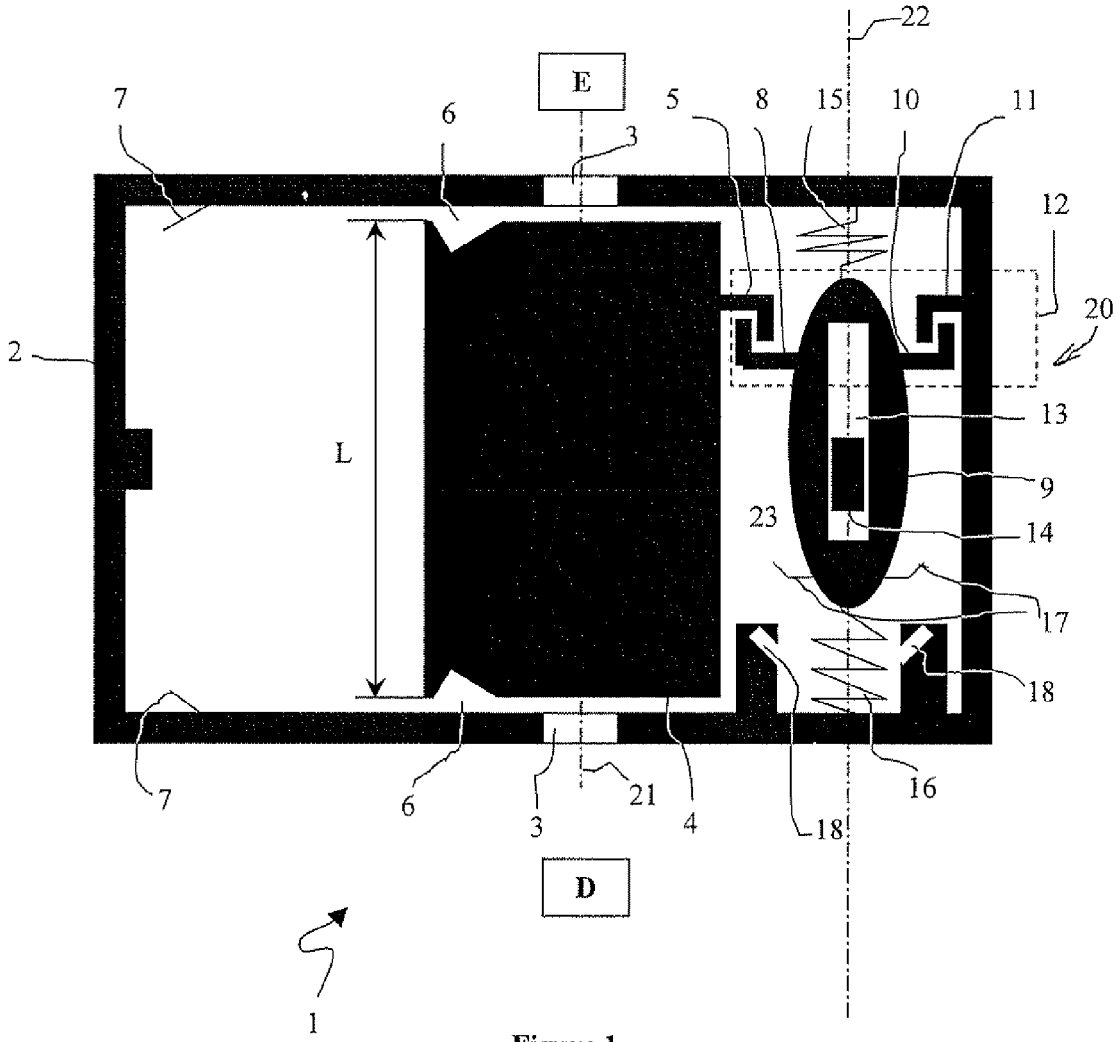
FIG. 1 shows the safety and arming device in the safety position.

According to FIG. 1, a safety and arming device 1 is mounted on an explosive projectile and separates a detonator positioned, for example, under the device (reference D) and an explosive load positioned above the device (reference E). The projectile, detonator and explosive load are not shown.

The safety and arming device 1 is made, as that described in patent EP-2077431, using MEMS technology (device micro-machined or micro-engraved on a substrate).

It thus comprises a body 2 (or substrate) onto which a slider 4 is mounted that ensures the interruption of the pyrotechnic train.

The body 2 incorporates two holes 3 arranged on either side of the slider 4. The axis 21 of these holes 3, thus the pyrotechnic train's (D-E) direction of action is thus substantially parallel to the plane of the slider 4.

Such an arrangement of a pyrotechnic train shutter wherein the direction of the pyrotechnic train lies opposite the thickness of the slider 4 and not perpendicular to the plane of the slider (as in usual MEMS devices) is known namely by patent EP-1780496.

The person skilled in the art will refer to this patent which describes the general characteristics of such a type of priming chain and of the slider associated with it.

Note also that the detonator D must of the minimal size enabling it to ensure functioning and that it is coupled with an explosive charge or suitable pyrotechnic relay E. It has been verified that by implementing a detonator incorporating an output stage of 10 milligrams of Hexogen coupled with a very insensitive relay, for example, of HNS (hexanotrostilbene), it is possible to produce holes 3 (or transmission channels) of less than 1 $mm^2$ in section (diameter of the channel of around 1 mm) whilst guaranteeing the initiation transmission required.

It is thus possible for the pyrotechnic effect to be interrupted by a silicon slider with a length L of 3 mm, which is perfectly possible using MEMS technology. This length of the silicon of around 3 mm thus corresponds here to the dimension L of the slider 4 referenced in FIG. 1.

The body 2 is substantially parallelepipedic in shape. The body 2 is pierced on either side of the slider 4 by aligned holes 3 that form a slot through the body 2 constituting a direction of action 21 for the pyrotechnic train. The interior of the body 2 incorporates the slider 4 that is positioned substantially at the centre of the device 1 and an inertial lock 20 arranged to one side of the body. The slider 4 incorporates a hook 5 on its rear side opposite the lock 20 as well as two notches 6 on two other sides opposite the edges of the body 2 carrying the holes 3.

The interior of the body 2 also incorporates two elastic lugs 7 micro-machined with the body 2, lugs which are inclined in the direction of movement of the slider and which are facing one another. These lugs 7 have substantially the same orientation as the notches 6 of the slider 4. They are deformed by the passage of the slider 4 and thereafter come to lodge in the notches 6.

In the safety position shown in FIG. 1, the hook 5 is engaged in a first spigot 8 integral with a counterweight 9 of the inertial lock 20. The counterweight 9 has a second spigot 10 arranged symmetrically to the first one 8 with respect to a direction 22 of movement of the counterweight 9. This second spigot 10 is engaged in a second corresponding hook 11 integral with the body 2. The hook and spigot assembly is called the attachment means 12.

The counterweight 9 is positioned laterally to the slider so as to move in the same plane as the slider 4 but in a perpendicular direction to the movement of the slider 4. Thus, the assembly remains compact, the thickness of the device not being increased by the stroke of the counterweight 9.

The counterweight 9 is retained at each of its ends and along the same longitudinal axis 22 by two springs 15 and 16. The counterweight 9 incorporates a groove 13 oriented along a longitudinal axis 22. This groove 13 passes through the counterweight 9 transversally. Inside the groove 13 there is a fixed guiding pin 14 integral with the body 2 by a bottom wall 23 on which the body 2 is positioned as well as the different mobile parts (slider 4, counterweight 9, . . . ).

The lower part of the counterweight 9 incorporates a pair of tongues 17. On either side of the lower spring 16 there are two body walls that incorporate notches 18 to receive the tongues 17. The assembly formed by the tongues 17 and the notches 18 constitutes means to block the inertial lock 20 in its unlocked position.

Still according to FIG. 1, since the device is in its safety position, the slider 4 is understood to be joined to the body 2 of the device by the hooking means 12. In this way, the inertial lock 20, and in particular the counterweight 9, is not pushed away by the slider 4 from its aligned position along axis 22 further to any impacts received by the device 1 during the logistic phases or when the projectile is being rammed into position in the weapon.

Figure 2:
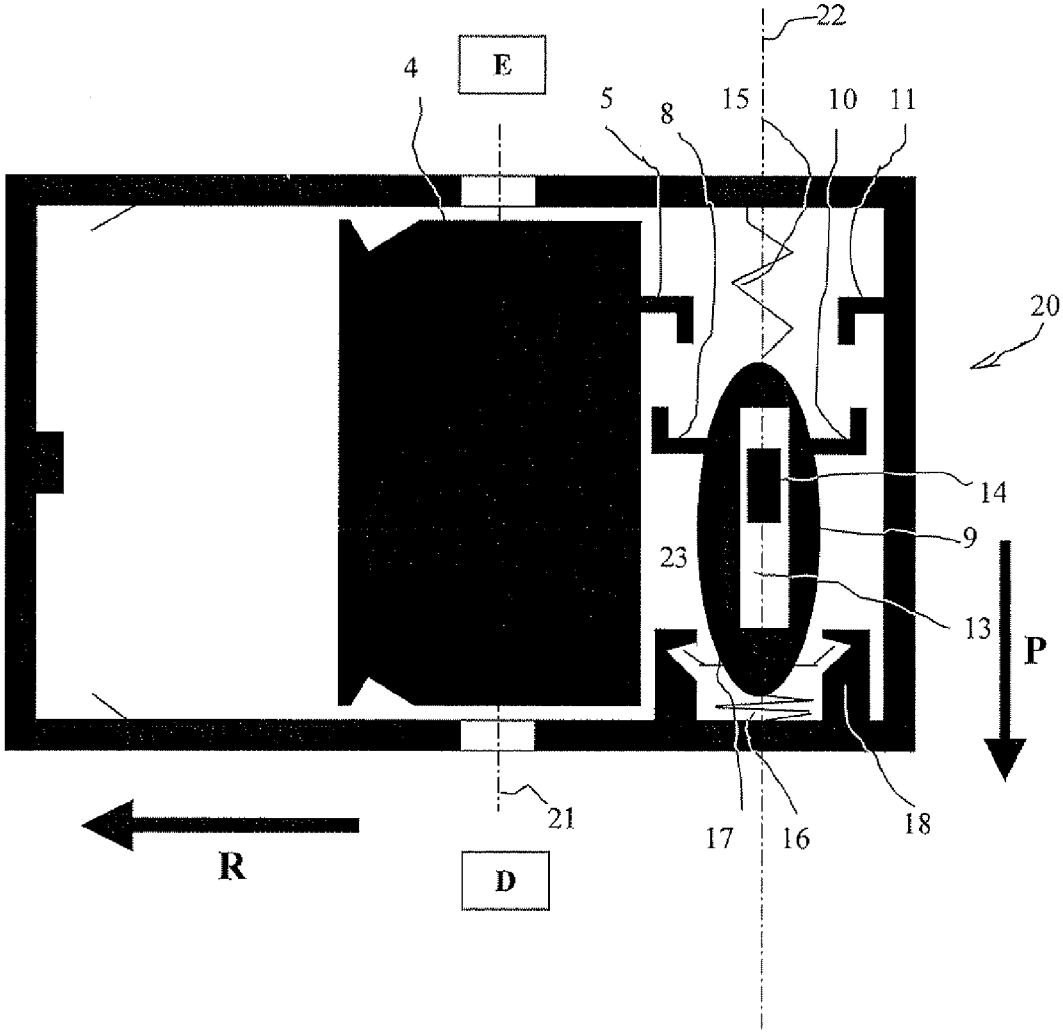
FIG. 2 shows the safety and arming device with the inertial lock in the process of unlocking.

FIG. 2 shows the device during the firing of a projectile. The acceleration due to firing generates a stress P that pushes back the counterweight 9. This movement of the counterweight 9 causes the spigots 8 and 10 of the hooking means to disengage from the hooks 5 and 11. Note that, to do this, the spigots 8 and 10 and the hooks 5 and 11 are positioned such that the hollows (or ends) of the hooks are oriented downwards and that of the spigots upwards.

The upper spring is thus extended whereas the lower spring 16 is compressed. Such an assembly of the counterweight 9 between two springs 15 and 16 mounted in opposition to one another helps to limit any buckling of the compressed spring, to improve guiding accuracy and above all to control the stiffness required for the inertial lock.

During its translation, the counterweight 9 is guided by the pin 14 positioned in the groove 13, aligned with axis 22 that is also that of the springs and of the inertial stress P. At the end of its stroke as seen in FIG. 2, the inertial lock 20 is locked by the tongues 17 engaging in the notches 18.

From then on the slider 4 is free to translate and under the effect of the centrifugal acceleration R due to the projectile's spin it is able to slide to the end of the body 2 of the device positioned opposite the inertial lock 20.

For safety reasons, the safety and arming device 1 should not be in the armed position before the projectile has left the gun barrel. For this, braking means which are not shown but which are described in patent EP2077431 will slow down the stroke of the slider 4 so that the latter only reaches its position at the end of its stroke in contact with a limit stop 25 once the projectile has exited the barrel.

Figure 3:
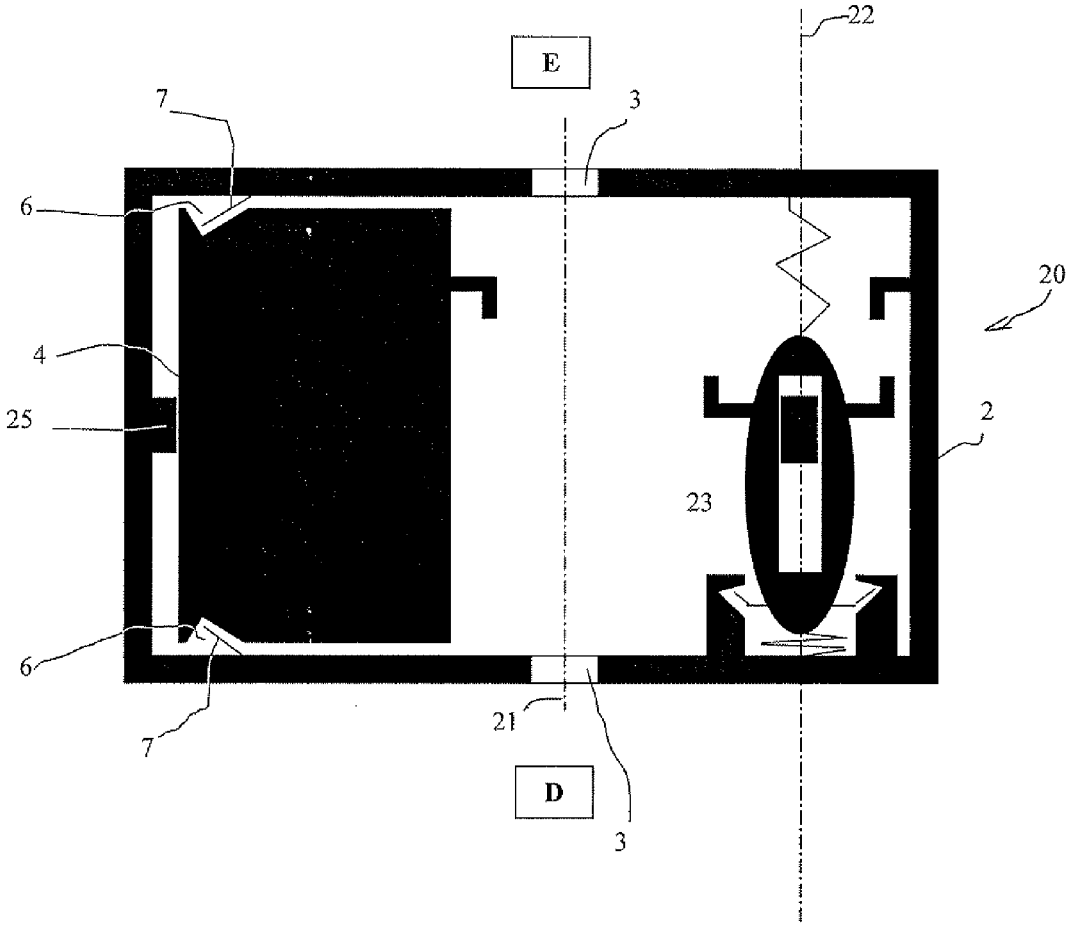
FIG. 3 shows the safety and arming device in the armed position.

FIG. 3 shows the device 1 in the armed position. The slider 4 is here stopped 25 in the body 2.

The lugs 7 are engaged in the notches 6 and lock the slider 4 in its armed position. The holes 3 are thus released and the initiation of the detonator D will be able to cause the detonation of the explosive load E.

What is claimed is:

1. A MEMS safety and arming device for projectiles that each include a detonator and an explosive, said safety and arming device comprising:

a body;

a slider mobile between: a) a safety position in which the detonator is isolated from the explosive, and b) an arming position in which the detonator is able to communicate with the explosive; and at least one inertial lock;

wherein the slider is configured to be mobile under the effect of a centrifugal acceleration with respect to the body, wherein the slider is immobilized in said safety position by the at least one inertial lock configured to release the slider when moving in an unlocked position in which the at least one inertial lock is blocked by a blocking system, wherein said at least one inertial lock includes a counterweight having at least one straight groove whose longitudinal axis is parallel to a direction of movement of said at least one inertial lock, wherein a fixed guiding pin is positioned in said groove, said guiding pin being integral with said body, wherein said groove is of a length sufficient to allow the displacement of said counterweight with respect to said guiding pin, and wherein a hooking system is integral with said counterweight, and said slider is maintained in said safety position by said hooking system.

2. The MEMS safety and arming device according to claim 1, wherein said hooking system comprises at least one first spigot corresponding with at least a first hook shape integral with said slider and at least a second spigot corresponding with at least a second hook shape integral with said body of said safety and arming device, said first and second spigots being oriented in the same direction, the ends of said spigots being oriented in a direction opposite of a direction of movement of said counterweight of said inertial lock moving toward said unlocked position.

3. The MEMS safety and arming device according to claim 1, wherein said guiding pin comprises a rectangular section substantially occupying the full width of said groove.

4. The MEMS safety and arming device according to claim 1, wherein said counterweight is suspended between at least two springs whose principal strain axis is parallel to the direction of movement of said inertial lock.

5. The MEMS safety and arming device according to claim 2, wherein said guiding pin comprises a rectangular section substantially occupying the full width of said groove.

6. The MEMS safety and arming device according to claim 2, wherein said counterweight is suspended between at least two springs whose principal strain axis is parallel to the direction of movement of said inertial lock.

7. The MEMS safety and arming device according to claim 3, wherein said counterweight is suspended between at least two springs whose principal strain axis is parallel to the direction of movement of said inertial lock.

8. The MEMS safety and arming device according to claim 1, wherein said blocking system comprises notches of the body intended to block tongues of the counterweight.

* * * * *